US010249463B1

(12) United States Patent
Heil et al.

(10) Patent No.: US 10,249,463 B1
(45) Date of Patent: Apr. 2, 2019

(54) MAGNETICALLY OPERATED ELECTRO-MECHANICAL LATCHING SWITCH

(71) Applicant: Scientific Components Corporation, Brooklyn, NY (US)

(72) Inventors: Theodore C. Heil, Gilgo Beach, NY (US); Ben Tabrizi, Harvard, MA (US); Manor Iosilevich, Franklin Square, NY (US)

(73) Assignee: Scientific Components Corporation, Brooklyn, NY (US)

( * ) Notice: Subject to any disclaimer, the term of this patent is extended or adjusted under 35 U.S.C. 154(b) by 0 days.

(21) Appl. No.: 15/449,089

(22) Filed: Mar. 3, 2017

Related U.S. Application Data

(60) Provisional application No. 62/303,656, filed on Mar. 4, 2016.

(51) Int. Cl.

| | |
|---|---|
| ***H01H 53/00*** | (2006.01) |
| ***H01H 50/18*** | (2006.01) |
| ***H01H 51/22*** | (2006.01) |
| ***H01H 50/02*** | (2006.01) |
| ***H01H 50/36*** | (2006.01) |

(52) U.S. Cl.
CPC ..... *H01H 50/18* (2013.01); *H01H 50/02* (2013.01); *H01H 50/36* (2013.01); *H01H 51/22* (2013.01)

(58) Field of Classification Search
CPC ..... H01H 53/00; H01H 30/34; H01H 63/02; H01H 7/16; H01H 77/00; H01H 1/00; H01H 67/02; H01H 15/00
USPC ..... 335/4
See application file for complete search history.

(56) References Cited

U.S. PATENT DOCUMENTS 4,298,847 A * 11/1981 Hoffman ..... H01P 1/125 333/105
4,908,588 A * 3/1990 Hoffman ..... H01P 1/125 333/105
5,063,364 A * 11/1991 Tsoi ..... H01H 51/2263 200/504
5,499,006 A * 3/1996 Engel ..... H01P 1/12 333/105
5,699,030 A * 12/1997 Leikus ..... H01H 50/02 333/105

(Continued)

*Primary Examiner* — Shawki S Ismail
*Assistant Examiner* — Lisa N Homza
(74) *Attorney, Agent, or Firm* — Lawrence G. Fridman, Esq.; Feigin & Fridman, LLC

(57) ABSTRACT

A latching electromechanical RF switch is formed with an RF switch cavity having at least one inlet port and at least one outlet ports having switch contacts. A leaf contact member moveable between a first contact position connecting the switch contacts and a second position spaced from the switch contacts. A solenoid mounted in the cavity. A housing is formed with a hollow passage. An intermediate permanent magnet provided within the housing. A connecting member assembly is moveable within the hollow passage. The contact leaf member is connected to one end with a permanent magnet provided at another end of the connecting member. The intermediate magnet attracts and retains the permanent magnet and the contact leaf member in the first contact position. Upon reaching the first contact position electric current supply to the solenoid is terminated.

20 Claims, 5 Drawing Sheets

(56) References Cited

U.S. PATENT DOCUMENTS

| | | | | |
|---|---|---|---|---|
| 5,815,057 | A * | 9/1998 | Hoffman | H01H 51/2209 335/179 |
| 5,894,255 | A * | 4/1999 | Wallintin | H01H 50/043 335/124 |
| 6,037,849 | A * | 3/2000 | Ciezarek | H01H 50/541 333/105 |
| 6,124,771 | A * | 9/2000 | Kim | H01H 50/646 333/105 |
| 6,133,812 | A * | 10/2000 | Magda | H01H 51/2209 333/105 |
| 6,204,740 | B1 * | 3/2001 | Nakahata | H01H 50/02 333/103 |
| 6,211,756 | B1 * | 4/2001 | Sun | H01H 50/10 335/4 |
| 6,337,612 | B1 * | 1/2002 | Kim | H01H 51/2209 335/229 |
| 6,650,210 | B1 * | 11/2003 | Raklyar | H01P 1/125 200/504 |
| 7,843,289 | B1 * | 11/2010 | Raklyar | H01H 1/06 200/16 R |
| 8,786,388 | B2 * | 7/2014 | Ramezanian | H01H 1/06 335/126 |
| 9,672,967 | B1 * | 6/2017 | Gattrell | H01F 7/20 |
| 2009/0160585 | A1 * | 6/2009 | Raklyar | H01P 1/125 335/4 |

* cited by examiner

MAGNETICALLY OPERATED ELECTRO-MECHANICAL LATCHING SWITCH

RELATED APPLICATIONS

This patent application claims the benefit under 35 USC 119(e) of U.S. Provisional Patent Application No. 62/303,656, filed Mar. 4, 2016 and entitled "Magnetically Operated Electro-Mechanical Latching Switch", the entirety of which is incorporated herein by reference.

FIELD OF THE INVENTION

The invention relates to electro-mechanical relays provided to perform switching functions between input and outputs ports covering RF microwave signals.

BACKGROUND OF THE INVENTION

Electro-mechanical relays belong to a very broad technological field covering various signals, such as digital signals, DC voltage signals, AC signals, etc. Mechanical switches that are based on magnetic mechanisms to facilitate the switching function are known in the art. Many manufactures of the microwave mechanical and electromechanical switches utilize various spring arrangements to perform the switching function from one input to multiple outputs.

In the applicant's own approach, a combination of permanent magnets and electrical solenoids has been utilized to move connecting elements associated with push reeds to provide connection between input and outputs. The advantage of using a combination of magnets and solenoids over mechanical springs mechanisms is that such combination arrangements provide significantly greater switching life compared to the pure mechanical designs. For the purposes of the application the switching life is considered to be a number of cycles the switching function is carried out between input and output ports of a switch. Applicant's (Scientific Components Corporation) own switching devices provide a very substantial switching life of over 10 million cycles, compared to about 1-2 million cycles typical for the industry.

On the other hand, a drawback of pure springless or frictionless mechanisms of the prior art is that in order to maintain a continuous switch function, a user needs to constantly apply a voltage or a signal to electrical solenoids forming a part of the switch. Otherwise such switches naturally revert back to their original state. This approach is not always beneficial to users who are selecting a predetermined switch position and wish to retain such position for an extended period of time. Furthermore, the voltage has to be constantly delivered to the switching device to keep the solenoid active. This results in undesirable heat generation and wasted power consumption.

Thus, it has been long felt and unsolved need to provide a latching electromagnetic RF switch operated without use of mechanical mechanisms and adapted to hold the switch in a desired state after a pulse of current has been removed from a solenoid.

SUMMARY OF THE INVENTION

This invention provides a latching electromagnetic RF switch device having the capability of switching between RF switch states. The switch of the invention offers the latching function without use of mechanical mechanisms adapted to hold the switch in the desired state after a pulse of current has been removed from the solenoid. This is accomplished by means of an additional set of intermediate Ferromagnetic materials/permanent magnets enabling the latching mechanism of the invention to retain the upward position of the connecting elements, with the reed engaging the contacts of the respective ports and to maintain a gap between the polarity of the permanent magnet of the connecting element and the polarity of the ferromagnetic element of the solenoid. The repelling/attracting forces acting on the permanent magnet of the connecting element are no longer needed, so that the power can be terminated to render the solenoid powerless. The latching mechanisms of the invention provides a user with the ability to leave the switch in either position in a permanent state, without the need of continuously applying the voltage to the solenoids.

A latching electromechanical RF switch of the invention is formed with an RF switch cavity having at least one inlet port and at least two outlet ports. Each port has an inner conductor extending into said cavity and having a switch contact thereon. A reed or a contact leaf member is moveable between a first contact position connecting the switch contacts and a second position spaced from the switch contacts. At least two solenoids are mounted to a wall of the RF cavity opposite to the ports. Each solenoid has a ferromagnetic member. At least two housings are disposed within the RF cavity between the ports and the solenoids. Each housing is formed with a hollow passage extending along a longitudinal axis thereof. An intermediate permanent magnet is provided within each housing. A connecting member assembly is formed with a connecting member having distal and proximal ends. The connecting member is moveable within the hollow passage, with the reed or contact leaf member being connected to the proximal end, and a permanent magnet provided at the distal end. Each intermediate magnet is arranged to attract and retain the permanent magnet, and ultimately to retain the connecting element and the reed in the contact position. Upon reaching the contact position electric current supply to the electromagnet coil can be terminated.

DETAILED DESCRIPTION OF THE INVENTION

Figure 1:
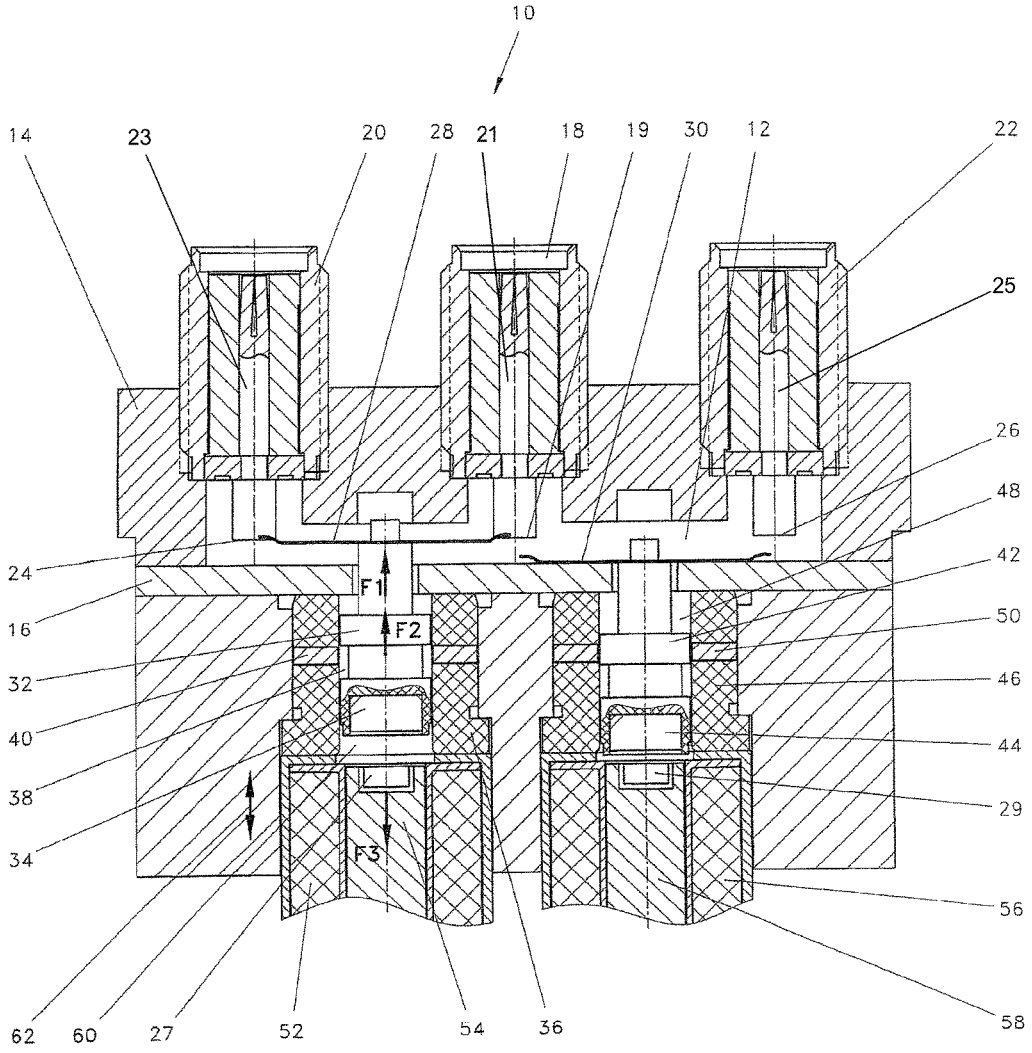
FIG. 1 illustrates one embodiment of the magnetically operated electro-mechanical latching switch of the invention.

With reference to FIG. 1 there is shown a latching electromagnetic RF switch 10 according to the present invention. In the illustrated embodiment one input port 18 is positioned in the central area, whereas first 20 and second 22 output ports are disposed on both sides of the input port. Although the drawing illustrates the switch with one input and two output ports, it should be understood that that switches with multiple input and output ports are within the scope of the invention. Furthermore, a switch module with one input and one output ports is also contemplated. The switch 10 includes an RF switch cavity 12 having first and second base walls 14 and 16. Inlet 18 and outlet ports 20 and 22, (which may, for example, be coaxial connectors of the SMA type) are provided within the first base wall 14. In another variation, the RF ports might be other than coaxial, such as strip line, micro strip line or other transmission line known in the art. Solenoids 52, 56 having ferromagnetic cores 54,58 are accommodated outside of the second wall 16 and are mounted near the RF cavity at an area opposing the inlet and outlet ports. The ports include inner conductors 21,23 and 25 which extend into RF cavity 12 and having end surfaces forming contact members 19, 24 and 26 for electrical connection to respective reeds or contact leaf members 28, 30. First and second housings 36, 46 are provided within the cavity and formed with hollow central passages 38, 48 to accommodate longitudinal motion of the respective connecting elements/members 32, 42 each extending between distal 43,45 and proximal 33,35 ends thereof. Reeds or contact leaf members 28, 30 are connected to the proximal ends 33,35, whereas permanent magnets 34, 44 are provided at the distal ends 43,45. A homogeneous and finely finished surface of the central passages facilitates movement of the connecting elements.

Intermediate, donut shaped permanent magnets and/or ferromagnetic material 40, 50 are mounted within the respective housings 36, 46 in such a manner that central openings 47,49 of the intermediate magnets coincide with the longitudinal axes of the hollow passages. In the illustrated embodiment each intermediate magnet is disposed within the body of the housing in such a manner that an inner surface of the central opening 47,49 is in flash with an inner surface of the hollow passage. The switch 10 is illustrated in FIG. 1 with two output ports 20, 22, two connecting element assemblies 32, 42 and two housings with intermediate magnets and/or ferromagnetic material 40, 50, etc. However, the switch is contemplated with as many as 12 output ports having the corresponding number of actuators, housings and intermediate permanent magnets and/or ferromagnetic material that can selectively apply the current to the solenoids so as to selectively engage or disengage the contacts.

Figure 2:
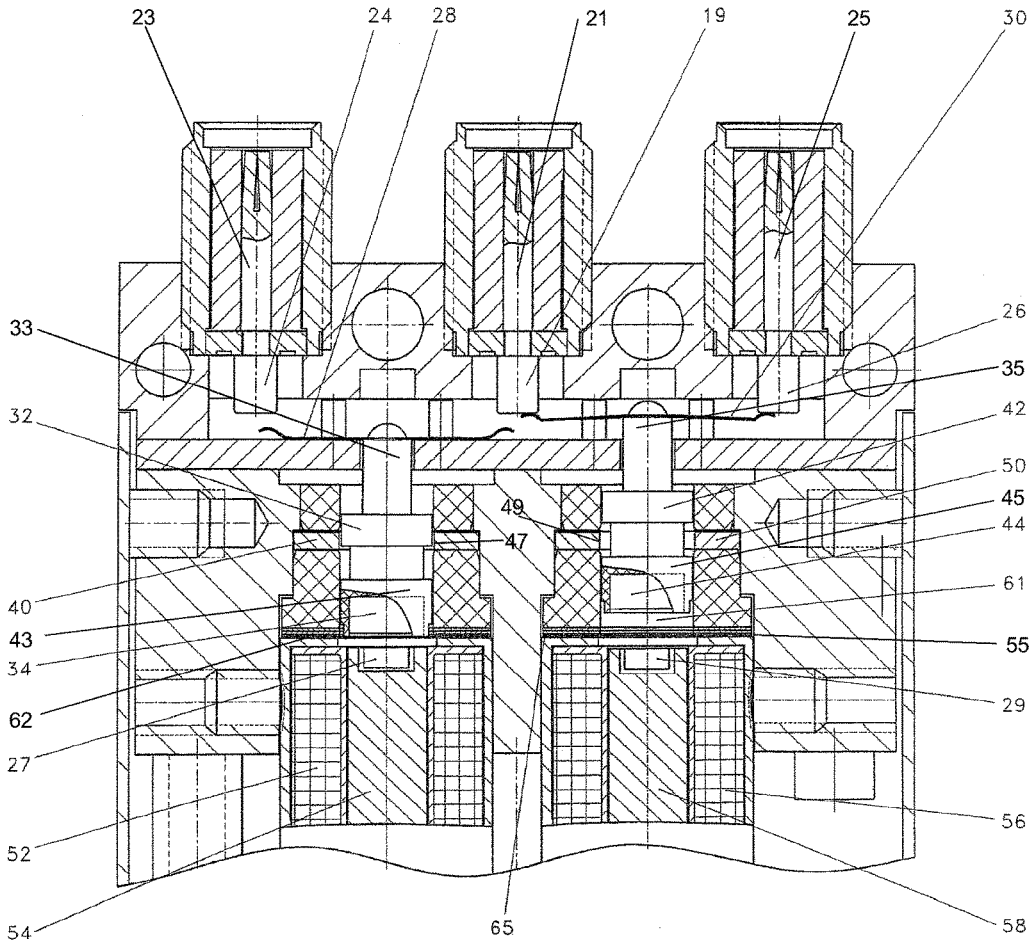
FIG. 2 illustrates another embodiment of the latching switch of the invention.

The connecting elements and the reeds or contact leaf members are moveable within the cavity between a first contact position connecting the switch contacts (illustrated in the left side of FIG. 1) and a second contact position with the reed being spaced from the switch contacts (illustrated in the right side of FIG. 1). To achieve the second contact position with the reed disconnected from the contacts (illustrated in the right side of FIG. 1), the permanent magnet 44 is attracted to core 58 and the reed 30 remains disengaged from contacts 19 and 26. As illustrated in FIG. 2, to change the switch state, the solenoid 52 is energized with a pulse of current, which causes the ferromagnetic element 54 to have magnetic polarity attracting the permanent magnet 34. It will be discussed below that this action also overcomes an additional repelling force between permanent magnets 27 and 29, situated in top cavities of the respective cores, and the permanent magnets 34,44. At the same time solenoid 56 is also energized with a pulse of current which causes a ferromagnetic element 58 to have magnetic polarity to repel the permanent magnet 44 and move the connecting reed 30 upward to connect contacts 19 and 26. To maintain this position both solenoids 52 and 56 need to remain energized.

The above-discussed functionality is known in the art and represent operation of a conventional switch. In order to maintain the switch in the above-discussed connected state shown in FIG. 2, the magnetic field has to be maintained in the solenoid 56 to support the required continues repelling magnetic field function. Also, the magnetic field has to be maintained in solenoid 52 to maintain connecting reed 28 in the disengaged position. An important drawback of the above-discussed prior art switch is that to maintain connection between the contacts 19, 26 and to keep the connecting element 42 away from the solenoid 56, the magnetic field of the solenoid 56 has to be continuously maintained to keep the switch in the state illustrated in the right side of FIG. 2. Furthermore, the magnetic field has to be initiated in the solenoid 52 to provide the attracting magnetic field function, which can be removed thereafter due to attraction of the permeant magnet 34 and core 54. For the above operations continuous flow of electric current into the solenoids 52 and 56 has to be provided. In view of similar logic continuous flow of electric current into the solenoids 52 and 56 has to be provided to maintain the connected state of the switch illustrated in FIG. 1. It should be noted that such continuous flow of the current to the solenoids radiates additional heat weakening generated magnetic forces and wasting power.

To eliminate the drawback of the above-discussed prior art functionality, in the present invention a latching mechanism is formed having the intermediate donut-shaped magnets and/or ferromagnetic material 40,50 disposed within the housings 36,46. In the latching mechanism of the invention the engaged state of the reed 28 (see the left side of FIG. 1) is maintained without electrical current being continuously supplied to the solenoid 52. After the solenoid 52 is energized to cause the magnetic polarity repelling the permanent magnet 34, the connecting element 32 is moved upwardly. In this state the intermediate permanent magnet and/or ferromagnetic material 40 will attract and retain the permanent magnet 34. Thus, the connecting element 32 and the reed 28 will be kept in the first contact position engaging the contacts 19 and 24 and the gap 60 will be maintained. As a result, delivery of the current pulse, previously required to maintain the solenoid 52 in the energized state (essential for the repelling action), is no longer needed and can be terminated to render the solenoid powerless.

We are referring now to the right side of FIG. 1 illustrating the second contact position of the switch. In order to disconnect the reed 30 from its engagement with the contacts 19 and 26 of the input and output ports 18,22, the direction of the current that flows through the solenoid 56 has to be reversed. This is needed to create a magnetic field of the opposite direction in the solenoid 56, which generates the attraction magnetic force between the permanent magnet 44 of the connecting element 42 and the solenoid 58. The goal of this magnetic field of the reversed polarity is to overcome the attraction between the intermediate magnet or ferromagnetic material 50 and the permanent magnet 44. In this manner, the connecting element 42 pulls the reed 30 down into the open disconnected position. In this state, because of the attraction between the permanent magnet 44 and the magnetic forces remaining in the solenoid 56, the gap 60 is closed and the switch stays in the disconnected position with the reed 30 and contacts 19,26 being separated from each other. Thus, the flow of electrical current can be removed/disconnected from the solenoid 56.

To energize/activate the second output port 26 (see FIG. 2), a magnetic field of the opposite direction, compare to the previously discussed, has to be created in the solenoid 56. After that the method steps similar to the above-discussed are repeated. That is to pass the current through the second solenoid 56 to create the magnetic field of the opposite polarity to the magnetic field of the permanent magnet 44. This is needed to repel the magnet 44 and to form the gap 61. Again, based on the essential aspect of the invention, the permanent intermediate magnet or ferromagnetic material 50 will attract and retain the permanent magnet 44 in the upward position, with the reed 30 engaging and connecting the ports contacts 19 and 26, so that the power can be removed from the solenoid 56.

Once the connecting element with the permanent magnet 34 is moved up, the intermediate magnet or ferromagnetic material 40 generates the attraction forces/magnetic field, so as to keep the connecting element and the reed in the upward engaged position (as illustrated in left side of FIG. 1). This position has to be strong enough to withstand mechanical shocks, vibrations and to assure that slight movements of the reed 28 do not cause its retraction from the contacts 24,30. The attraction between the permanent magnets and the intermediate magnets and/or ferromagnetic material is critical to the reliability of the reed-contacts engagement, needed to accommodate the engaged state, despite the mechanical forces which tend to create their separation.

On the other hand, while engagement between the reeds and the contacts of the ports is achieved, it is essential to maintain a specific predetermined amount of the force exerted by the reeds on the contacts. For a proper switch operation, this force has to be a minimal and should not exceed a predetermined amount. The goal is provide low contact resistance engagement between the reed 28 and the contacts 19,24. Application of a greater force exceeding the predetermined amount is undesirable since it is resulted in substantial wear and tear of the contacts, ultimately reducing the service life of the switch. To maintain the targeted service life of the switch, the engaging force has to be balanced to maintain a good contact resistance, not exceeding a predetermined amount.

For a proper operation, it is essential to provide predetermined strength and location of the intermediate magnets and/or ferromagnetic material 40,50 within the switch 10 in general and the housings 36,46 in particular. This is because these characteristics affect and balance the interaction of various magnetic forces. The location and strength of the intermediate magnets and/or ferromagnetic material 40,50 have to be such so as to attract and create a certain amount of action between the permanent magnets 34,44 and the intermediate magnets or ferromagnetic material 40,50. As the permanent magnets 34,44 are moved along with the respective connecting elements against the intermediate magnets 40,50, at one point attraction between the magnetic forces occurs, and at another point the magnets are repelled. These variable magnetic forces are not completely linear. For the invention it is essential to achieve the balance between the magnetic forces of attraction between these two magnets and the engaging forces generated when the reed is pushed against the respective contacts. If the engaging forces are too strong, not only the contacts will wear out fast, but it will be also difficult to separate the reeds and the contacts, when the switch has to be placed in to the open position (see the right side of FIG. 1, for example). This is because, in this situation, a substantial current has to be applied to create a major magnetic field in the solenoid 56 to overcome the forces of attraction needed to separate these two magnets and to pull the connecting element 42 down. Furthermore, if the position of the intermediate magnets 40,50 within the housings is not correct, upon termination of the current applied to the solenoids, such intermediate magnets will rapidly attract the respective permanent magnets 34,44 and the connecting elements will uncontrollably move upwardly again.

In FIG. 1 the arrow F1 illustrates the force moving the connecting element and the reed 28 in the upward direction, and ultimately causing the engagement between the reed and the port contacts 19 and 24. This upwardly directed force F1 reflects the balance between the forces of attraction between the permanent magnet 34 and the intermediate magnet or ferromagnetic material 40. More specifically, this balance force F1 is the reflection of the force F2 of the magnetic field of the intermediate magnet 40 minus the force F3 which is the summary magnetic interaction between the magnetic field of the connecting element magnet 34 and the magnetic field of the solenoid 52.

Equation (F1=F2−F3) (1) reflects the relationship between the above-discussed magnetic forces/fields. It should also be noted that as the connecting element moves, the value of the forces changes due to proximity, magnetic properties and interactions among all magnetic elements.

Thus, in order to increase the balanced force F1, either the F3 force has to be reduced or F2 force has to be increased. In the invention an adjustment arrangement 62 is provided for adjusting/reducing the F3 forces of magnetic interaction between the fields of the connecting element magnet 34 and the magnetic field of the solenoid metal core 54. For example, if the balanced force F has to be increased, F3 force can be decreased by moving the entire solenoid 52 or a portion thereof away from the housing 36. In one embodiment of the adjustment arrangement 62 a set of adjusting fasteners or spacers can be provided to move the entire solenoid 52 away or toward the permanent magnet 34. According to the embodiment of the invention illustrated in FIG. 2,3 and 4 the adjustment arrangement 62 is in the form of shims or spacers 65 interposed between the housings 36,46 and the solenoids 52,56 including the ferromagnetic members or core 54,58. By varying number and/or thickness of the shims or spacers 65, the solenoids 52 and 56 can be moved away or toward (up or down) with respect to the respective housings 36,46 and the permanent magnets 34,44. Under the current design between seven and ten shims 65 are available for this purpose. It should be noted however, that use of any reasonable number of the shims for the purposes of adjustment is within the scope of the invention.

An essential feature of the invention is that the position of the solenoid ferromagnetic core or the entire solenoids with respect to the connecting element permanent magnets 34,44 can be adjusted. This affects not only the force F3, but also ultimately affects the balanced force F1 required to retain the reeds 28,30 and the respective contacts 19, 24,26 in the proper engaged position. If the entire solenoids 52,56 or the solenoid ferromagnetic cores 54,58 are moved away from the connecting element, the balance force F1 of engagement increases. This is because the force F3 of attraction between the solenoid and the permanent magnet of the connecting element 34 has been reduced. Therefore, the resulted balanced force F1 which maintains the contact resistance has been increased.

The balanced force F1 can be also changed by adjusting position of the intermediate magnets 40,50 within the housings 36,46. In the embodiments of FIGS. 1 and 2 the intermediate magnets are disposed within central regions of the housings. On the other hand, in the embodiments of FIGS. 3 and 4 the intermediate magnets 40,50 are positioned at the bottom regions of the housings directly facing the cores 54,56 of the solenoids and permanent magnets 27 and 29. Other locations of the intermediate magnets within the housings are also contemplated.

Figure 3:
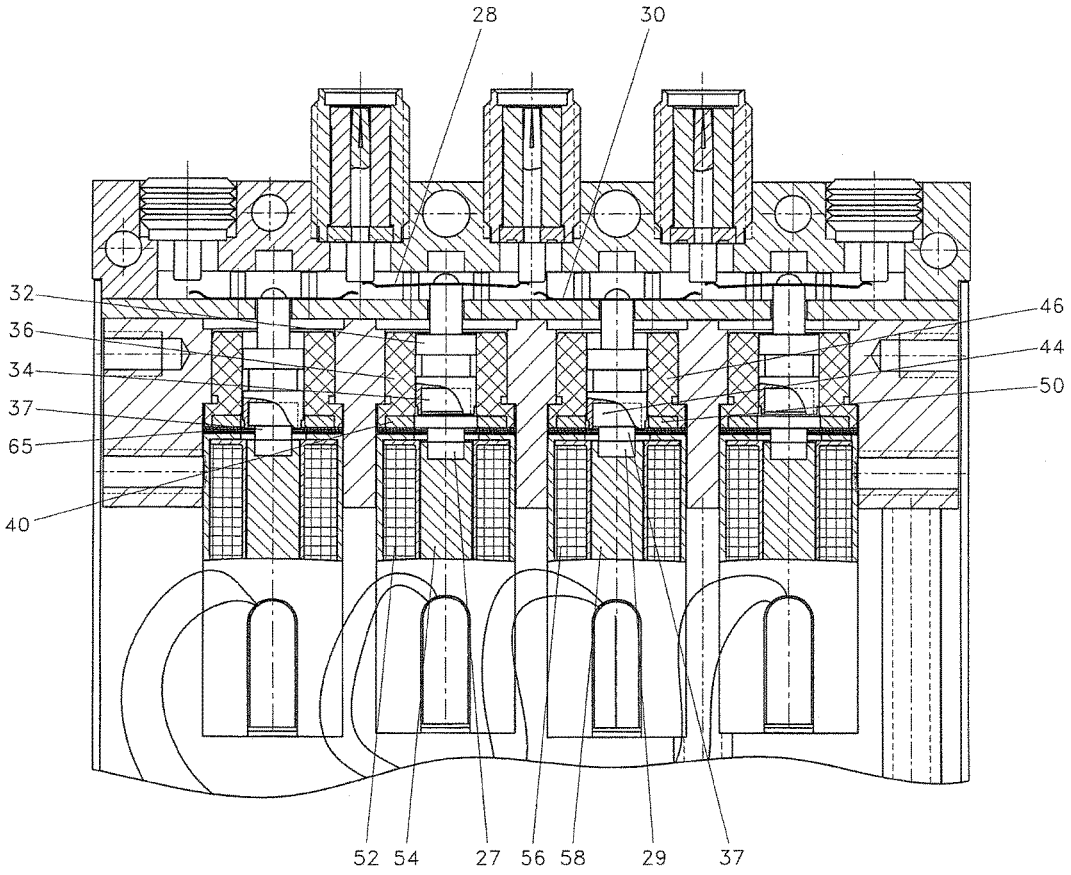
FIG. 3 illustrates a further embodiment the latching switch.
Figure 4:
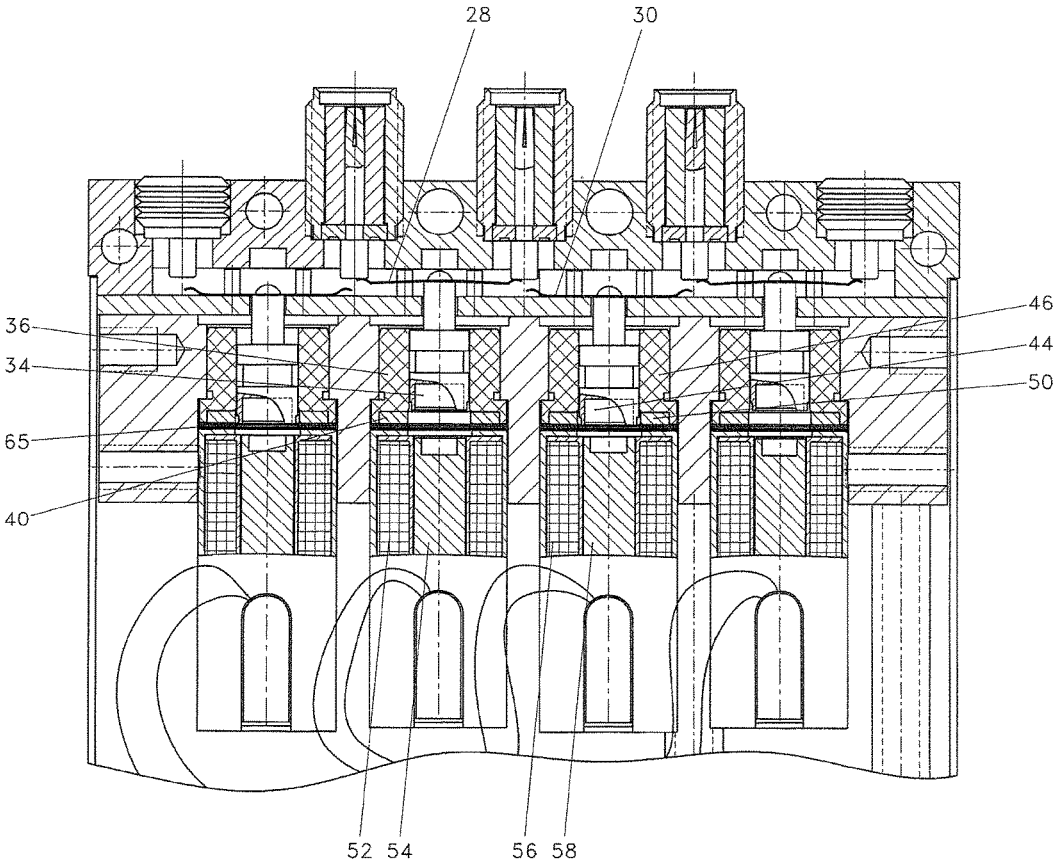
FIG. 4 illustrates still another embodiment the latching switch.

According to an aspect of the invention illustrated in FIGS. 1,2 and 3, permanent magnets 27,29 are provided within top core cavities of the ferromagnetic elements 54,58. The magnets 27,29 are provided for the repellent purposes to facilitate engagement between the reeds 28,30 and the respective contacts (see for example the left side of FIG. 1 and the right side of FIG. 2). In these states significant shock or vibration might cause the connecting elements 32,42 to move down, to be resulted in undesirable disengagement between the reeds 28,30 and the contacts 19,24,26. Positioning of the permanent magnets 27,29 into the top cavities of the cores 54,58 creates additional magnetic fields causing additional repelling action between the cores 54,58 and the permanent magnets 34,44. This additional repelling action pushes the connecting elements 32,42 with the reeds 28,30 upwardly, serving as a safeguard against losing contact between the reeds and the contact elements in case of shock or vibration.

We are referring now to the embodiment of FIG. 3, wherein ferromagnetic members 37, such as for example, pieces of stainless steel are provided on top of the permanent magnets 27,29 situated in the top cavities of the respective solenoids. As a result, the direction of the additional repelling forces generated by the magnets 27,29 becomes more direct and controllable. The ferromagnetic members 37 can be glued or otherwise attached to top surfaces of the permanent magnets 27,29. The function of the ferromagnetic member 37 is to more specifically/precisely direct the magnetic field of the permanent magnets 27 and 29. In this manner, the additional magnetic field of the core permanent magnets 27,29 become more focused and expanded.

The life of the switch is defined by the duration of a low and consistent contact resistance between the reed and the contacts. When the reed is in motion to reach the contacts, the initial impact force is controlled by the velocity of the reed when it reaches the contacts. This dynamic impact force is greater than the static force which maintains the travel path for the signal during the operation of the selected path. This additional force (Fad) which equals the dynamic force (Fdyn) minus the static force (Fstat) causes instantaneous instability of the contact which is included in the time before the switch is in the desired operating condition.

Equation (Fad=Fdyn−Fstat) (2) reflects the above discussed relationship between the dynamic and static forces resulted in the additional force. This additional force (Fad) also is one of the main causes for the contact wear and tear, and ultimately controls the life span of the switch.

One embodiment of the invention provides electro-mechanical switch having a pulse control arrangement for controlling the electromagnetic field generated by the solenoids. Various pulse patterns incorporating varied voltage levels and pulse widths can be used to energize the solenoids in various directions to control the magnet holder's acceleration, velocity, and ultimately impact force. Making the impact force as close to the static force as possible at the time of the contact should minimize the contact wear out and prolongs the life of the switch to several multiples of the current levels.

Using the pulse control approach the transition time can be kept short and close to the single pulse approach, while creating a controlled and soft landing of the reed onto the contacts. This in total should produce a shorter switching time as the contacts are stable at the time of the initial contact.

Figure 5:
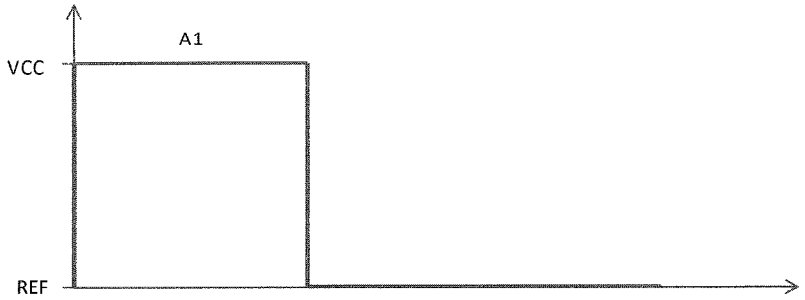
FIG. 5 is voltage over time diagram illustrating a single pulse approach.
Figure 6:
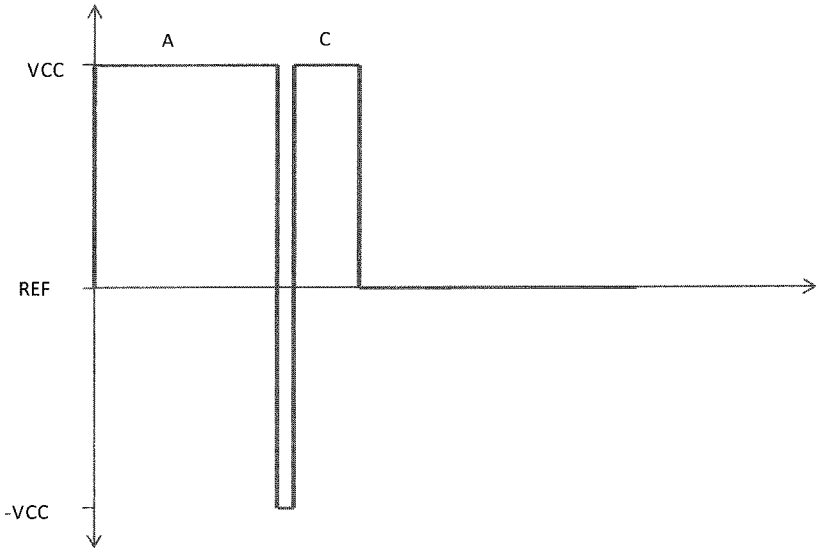
FIG. 6 is voltage over time diagram illustrating a multi-pulse approach of the pulse control arrangement for controlling an electromagnetic field of the invention.

As to diagrams of FIGS. 5 and 6, the vertical axis reflects to the voltage value and the horizontal axis reflects the time interval. In FIG. 5, pulse A1 represents the single pulse approach. The multi-pulse approach is illustrated in FIG. 6, wherein the pulse A is initially generated and, to offset the momentum, the pulse B is applied in the opposite direction, and then the short pulse C is provided to carry the reed to the contact point. In the invention the pulse control approach can be implemented by adding a programmable microchip to the circuitry of the switch to reverse the direction of the voltage and timing of the pulse. Thus, the pulse B as shown in the diagram of FIG. 6 is generated. By using the pulse control approach the life span of the switch of the invention is substantially increased.

What is claimed is:

1. A latching electromechanical RF switch comprising:

an RF switch cavity having at least one inlet port and at least one outlet ports, each having an inner conductor extending into said cavity and having a switch contact thereon;

a contact leaf member in said RF cavity and moveable between a first contact position connecting said switch contacts and a second position spaced from said switch contacts;

a solenoid mounted to a wall of said RF cavity opposite to said ports;

a housing within the RF cavity disposed between the ports and the solenoid, the housing having a hollow passage extending along a longitudinal axis thereof, an intermediate permanent magnet provided within the housing;

a connecting member assembly formed with a connecting member having distal and proximal ends and moveable within the hollow passage, the contact leaf member is connected to the proximal end with a permanent magnet provided at the distal end; and said intermediate magnet attracts and retains said permanent magnet said connecting element and said contact leaf member in said first contact position, upon reaching said first contact position electric current supply to the solenoid can be terminated.

2. The switch of claim 1, wherein in the second contact position of the switch direction of current in the solenoid is reversed to create attraction magnetic force between the permanent magnet of the connecting member and the solenoid to overcome the attraction between the intermediate magnet and the permanent magnet, so that electric current supply to the solenoid is terminated.

3. The switch of claim 1, further comprising an adjustment arrangement for adjusting forces of magnetic interaction between the connecting element magnet and the solenoid.

4. The switch of claim 3, wherein to adjust the forces acting on the contact leaf member by means of the adjustment arrangement the solenoid is moved away or toward the housing.

5. The switch of claim 4, wherein the adjustment arrangement is a set of adjusting fasteners provided to move the solenoid about the permanent magnet.

6. The switch of claim 5, wherein the housing accommodates the connecting member assembly (32,42), the solenoid and the housing are separated by a space (55), and the adjusting arrangement (62) is provided within said space.

7. The switch of claim 6, wherein the set of adjusting fasteners is positioned within the space, so that by varying number or thickness of the fasteners the solenoid is moved away or toward the housing.

8. The switch of claim 1, wherein said intermediate permanent magnet is formed having a donut shaped body with a central opening, the central opening of the intermediate magnet coincides with the longitudinal axis of the hollow passage of the housing.

9. The switch of claim 8, wherein to facilitate movement of the connecting member within the hollow passage said intermediate magnet is disposed within a body of the housing in such a manner that an inner surface of the central opening is in flash with an inner surface of the hollow passage.

10. The switch of claim 1, wherein the solenoid has a ferromagnetic member.

11. The switch of claim 1, wherein upon the solenoid being energized to cause the magnetic polarity repelling the permanent magnet, the connecting element is moved upwardly and the intermediate permanent magnet attracts and retains the permanent magnet, so that said first contact position is maintained without electrical current being supplied to the solenoid.

12. A latching electromechanical RF switch comprising:

an RF switch cavity having at least one inlet port and at least at least two outlet ports, each said port having an inner conductor extending into said cavity and having a switch contact thereon;

at least two contact leaf member in said RF cavity and moveable between a first contact position connecting said switch contacts and a second position spaced from said switch contacts;

at least two solenoids mounted to a wall of said RF cavity opposite to said ports;

at least two housings within the RF cavity disposed between the ports and the solenoid, each said housing having a hollow passage extending along a longitudinal axis thereof, an intermediate permanent magnet is provided within each said housing;

at least two connecting member assemblies each formed with a connecting member having distal and proximal ends and moveable within the hollow passage, the contact leaf member is connected to the proximal end with a permanent magnet provided at the distal end of each said connecting member; and in each said housing said intermediate magnet being arranged to attract and retain the respective permanent magnets, said connecting element and said contact leaf member in said first contact position, upon reaching said first contact position electric current supply to the solenoid is terminated.

13. The switch of claim 12, wherein in the second contact position of the switch direction of current in the solenoids is reversed to create attraction magnetic force between the permanent magnet of the connecting member and the solenoids to overcome the attraction between the intermediate magnet and the permanent magnet, so that electric current supply to the solenoids is terminated.

14. The switch of claim 12, wherein each said intermediate permanent magnet is formed having a donut shaped body with a central opening, the central opening of each said intermediate magnet coincides with the longitudinal axis of the hollow passage of the housing.

15. The switch of claim 12, further comprising an adjustment arrangement for adjusting forces of magnetic interaction between the connecting element magnets and each said solenoid.

16. The switch of claim 15, wherein to adjust forces acting on the contact leaf member by means of the adjustment arrangement the solenoids are moved away or toward the housing.

17. The switch of claim 16, wherein the housing accommodates the connecting member assemblies (32,42), the solenoids and the housings are separated by a space (55), and the adjusting arrangement (62) is provided within said space.

18. The switch of claim 17, wherein the set of adjusting fasteners is positioned within the space, so that by varying number or thickness of the fasteners the solenoids are moved away or toward the housing.

19. The switch of claim 12, wherein each said solenoid has a ferromagnetic member.

20. The switch of claim 12, wherein upon the solenoids being energized to cause the magnetic polarity repelling the permanent magnets, the connecting elements are moved upwardly, and the intermediate permanent magnets attract and retain the permanent magnets, so that said first contact position is maintained without electrical current being supplied to the solenoids.

* * * * *